US010445977B2

(12) United States Patent
Tovar et al.

(10) Patent No.: US 10,445,977 B2
(45) Date of Patent: Oct. 15, 2019

(54) GAMING MACHINE HAVING VERTICALLY TRANSLATING CURRENCY ACCEPTING DEVICE

(71) Applicant: AGS LLC, Las Vegas, NV (US)

(72) Inventors: Brian Edward Tovar, Atlanta, GA (US); Mark Robert Brandau, Johns Creek, GA (US); Kevin Lee Hohman, North Las Vegas, NV (US)

(73) Assignee: AGS LLC, Las Vegas, NV (US)

( * ) Notice: Subject to any disclaimer, the term of this patent is extended or adjusted under 35 U.S.C. 154(b) by 48 days.

(21) Appl. No.: 15/712,576

(22) Filed: Sep. 22, 2017

(65) Prior Publication Data

US 2019/0096169 A1 Mar. 28, 2019

(51) Int. Cl.
*G07F 17/32* (2006.01)

(52) U.S. Cl.
CPC ..... *G07F 17/3216* (2013.01); *G07F 17/3209* (2013.01); *G07F 17/3211* (2013.01); *G07F 17/3244* (2013.01); *G07F 17/3267* (2013.01); *G07F 17/3286* (2013.01)

(58) Field of Classification Search
CPC .. G07D 1/02; G07D 11/0006; G07D 11/0087; G07F 9/06; G07F 17/3216
USPC ..... 463/20; 194/350
See application file for complete search history.

(56) References Cited

U.S. PATENT DOCUMENTS 4,442,781 A * 4/1984 Fish ..... G07D 11/0006 109/24.1
5,676,231 A * 10/1997 Legras ..... G07F 7/04 194/206
6,019,207 A 2/2000 Cole
6,688,984 B2 2/2004 Cole
7,891,551 B2 * 2/2011 Cha ..... B65H 1/00 235/379
8,251,791 B2 * 8/2012 Baerlocher ..... G07F 17/32 463/16
2003/0064791 A1 4/2003 Hedrick et al.
2008/0087521 A1 * 4/2008 Cole ..... G07D 1/02 194/350
2008/0113821 A1 * 5/2008 Beadell ..... G07F 17/32 463/46
2008/0214293 A1 * 9/2008 Kelly ..... G07F 17/32 463/25
2009/0176582 A1 7/2009 Cole et al.
2009/0192938 A1 * 7/2009 Amos ..... G06Q 10/087 705/43
2013/0081923 A1 * 4/2013 Frady ..... G07F 7/04 194/302
2015/0045112 A1 * 2/2015 Donavan ..... G07F 17/3244 463/25
2015/0279146 A1 * 10/2015 Bird ..... G07F 1/041 194/203

(Continued)

*Primary Examiner* — Michael A Cuff
(74) *Attorney, Agent, or Firm* — Weide & Miller, Ltd.

(57) ABSTRACT

A gaming machine includes a vertically translating currency acceptor. The currency acceptor may be moved from a first, lowered position to a second, raised position along a substantially vertical path. The lowered position may comprise a use position where an acceptor slot of the currency acceptor is positioned for player input of currency but service access to the currency acceptor is limited. The raised position may comprise a service position where the acceptor is readily accessible for service.

20 Claims, 4 Drawing Sheets

(56) References Cited

U.S. PATENT DOCUMENTS

2015/0379801 A1* 12/2015 Daniels ..... G07D 11/0018
194/203
2017/0292316 A1* 10/2017 Chang ..... E05G 1/14

* cited by examiner

GAMING MACHINE HAVING VERTICALLY TRANSLATING CURRENCY ACCEPTING DEVICE

FIELD OF THE INVENTION

The present invention relates to wager-based gaming machines and similar devices which include a currency accepting device.

BACKGROUND OF THE INVENTION

Wager-based gaming machines which are configured to accept monetary value wagers from players are well known. In the early days, these machines comprised "slot" machines. The machines were referred to as "slot" machines because they included a coin-accepting slot into which a player inserted one or more coins in order to fund their wager and play the game offered by the machine.

Since then, wager-based gaming machines have been modernized, such as to accept paper currency (e.g. "bills") and in many cases, monetary value tickets or other media which represents monetary value. These machines may include a media reader, such as a currency (or currency and ticket) accepting device. Such devices are well known, and generally include an acceptor slot into which media such as currency or tickets is inserted by a user, one or more reading devices for reading information from the presented currency/ticket, and a transport and storage elements for routing accepted currency or tickets through the device from the acceptor slot for storage (and later retrieval by the machine operator). The currency acceptor slot is accessible at the exterior of the gaming machine and the reading and storage portions of the device are generally located securely within an interior portion of the gaming machine.

In particular, the acceptor slot of such a currency accepting device is preferably located so that it is ready visible and accessible to a player of the gaming machine. Locating the currency accepting device so that the acceptor slot is in a player-convenient location may mean, however, that the remainder of the currency accepting device (such as the reader and storage elements) are located within the gaming machine at a location where the device is difficult to access. This is problematic because once the storage element of the currency accepting device (such as a removable currency container thereof) is full, it must be accessed (such as to remove a full currency container and replace it with an empty one). Further, at various times, the reading, storage or other elements of the currency accepting device must be accessed for maintenance or the like.

As one example, U.S. Pat. No. 5,676,231 discloses a gaming machine having a rotating bill acceptor (40). This patent describes a gaming machine having a slanted or angled top (156). Due to the angled top of the gaming machine, a bill validator portion (42) of the bill acceptor (40) is readily accessible via an access door (172). However, the cash box (48) of the bill acceptor (40) is not readily accessible. As such, the entire bill acceptor (40) is configured to rotate from a normal use position in which the cash box (48) faces outwardly and is relative inaccessible (as illustrated in FIG. 2A) to an access position as illustrated in FIG. 2B where the cash box (48) faces upwardly and can be lifted out of the gaming machine.

However, the physical configurations of gaming machines are ever-changing and an improved currency accepting device mounting and access configuration is desired which addresses issues with newer gaming machine designs.

SUMMARY OF THE INVENTION

Embodiments of the invention comprise gaming machines having vertically translating currency accepting devices, configurations of currency accepting devices and methods of mounting and moving currency accepting devices.

One embodiment of the invention is a gaming machine comprising a cabinet defining at least one interior space, at least one display device, at least one player input device, a memory device, a controller, machine-readable code stored in the memory device and executable by the controller to present one or more wagering games comprising the display of game information via the at least one display device, and a currency acceptor at least partially located in the at least one interior space and movably mounted to the cabinet for movement between a first vertical position and a second vertical position along a substantially vertical path.

In one embodiment, the currency acceptor is movably mounted to a mounting bracket which is connected to the cabinet, such as by being connected to side wall supports of the cabinet. The bracket may define at least one generally vertically extending slot and the currency acceptor may be movably mounted along the at least one slot, such as via one or more pins which extend outwardly from the currency accept into engagement with the slot(s).

In one embodiment, the first vertical position is a lowered position and the second vertical position is a raised position.

The gaming machine may include a button deck which extends outwardly from the cabinet, wherein the currency acceptor comprises a currency acceptor head, and wherein the currency acceptor head is positioned above the button deck by a first distance when the currency acceptor is in the first vertical position and is positioned above the button deck by a second distance which is greater than the first distance when the currency acceptor is in the second vertical position.

The vertically translating currency acceptor may include a means for biasing which generates an upward biasing force upon the currency acceptor to move or aid in the movement of the currency acceptor from its lowered position to its raised position. The means for biasing may comprise at least one shock, such as a pneumatic shock having a body and an arm which is biased outwardly of the body, where the shock is positioned between the currency acceptor and the cabinet of the gaming machine. The translating currency acceptor may include at least one locking element for retaining or locking the currency acceptor in position, such as in the lowered position, against the biasing force.

In one embodiment, the vertically translating currency acceptor may comprise a housing, a currency acceptor head defining an acceptor slot, at least one reader, a currency storage area and at least one currency transport mechanism. The currency acceptor may be configured to accept currency and/or printed monetary value tickets or other media.

Another aspect of the invention is a gaming machine with a currency acceptor where the position of the currency acceptor can be adjusted in a "z"-direction or along a "z"-axis from the front to the back of the gaming machine. This allows the position of a currency accepting head (including a currency ramp thereof) to be adjusted so that it is properly positioned against a ledge or wall of a currency opening in a front of the gaming machine, such as in the door thereof.

In one embodiment, the currency acceptor is mounted to a mounting bracket. The mounting bracket is connected to the cabinet of the gaming machine, such as to a wall mount thereof. The mounting bracket defines a plurality of mounting apertures which are in different "z"-axis positions, such as in a nominal position and one or more forward or rearward positions thereof. The wall mount defines one or more corresponding mounting holes. In use, the user moves the currency acceptor to the proper aligned position and then fixed the position of the currency accept by passing a fastener through the mounting aperture which most closely aligns with the mounting hole in the wall mount.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise gaming machines having vertically translating currency accepting devices, configurations of currency accepting devices and methods of mounting and moving currency accepting devices.

One embodiment of the invention comprises a gaming machine with a vertically translating currency accepting device. Such a gaming machine may have various configurations. The gaming machine may be located at a casino (and as such may be referred to as a "casino gaming machine"). As described below, the gaming machine may be part of a gaming system, such as a casino gaming system which links two or more of the gaming machines or one or more gaming machines with other devices, such as one or more table games, kiosks, accounting systems or servers, progressive systems or servers, player tracking systems or servers or the like.

Figure 1:
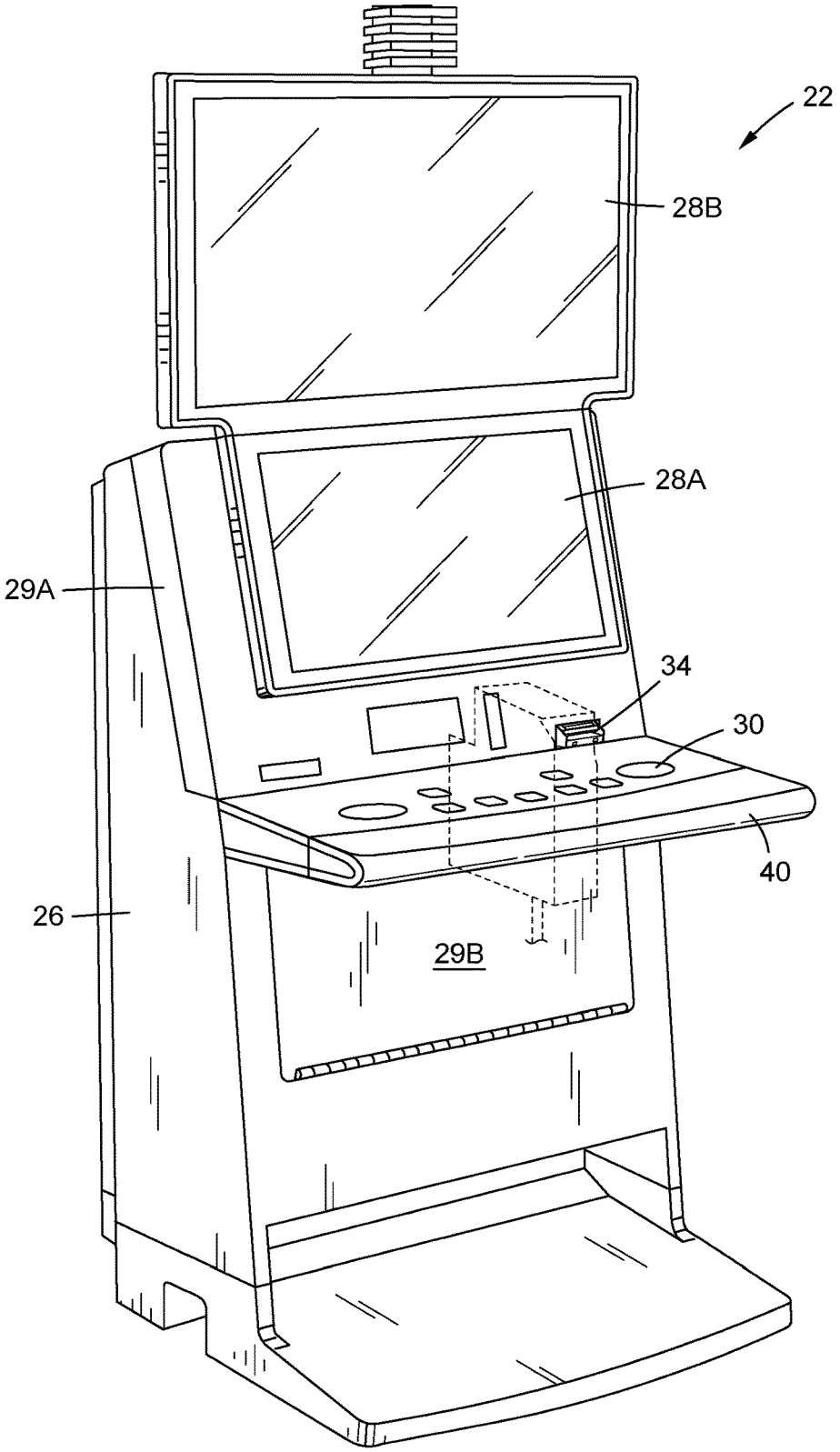
FIG. 1 illustrates one embodiment of a gaming machine in accordance with the invention.

One configuration of a gaming machine 22 is illustrated in FIG. 1. As illustrated, the gaming machine 22 generally comprises a housing or cabinet 26 for supporting and/or enclosing various components required for operation of the gaming machine. The cabinet 26 preferably includes one or more doors 29A,B or other access panels or features which can be moved between an open position which allows access to one or more interior portions of the gaming machine, and a closed position in which access to the one or more interior portions is generally prevented. The doors 29A,B may include locks or other features for securing them in their closed positions. The configuration of the gaming machine 22 may vary, such as having other shapes or dimensions.

The gaming machine 22 preferably includes at least one display device configured to display game information. The display device may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touchscreen, a light emitting display (LED) or other suitable displays now known or later developed, in a variety of resolutions, sizes and formats (e.g. 4:3, widescreen or the like). The display device may be capable of projecting or displaying a wide variety of information, including images, symbols and other indicia or information associated with game play, game promotion or other events. The gaming machine 22 might include more than one display device, such as two or more video displays which are associated with the cabinet 26. For example, the gaming machine 22 illustrated in FIG. 1 includes a main video display 28A which is located at a front of the cabinet 26 and a secondary video display 28B which is positioned above the main video display 28A and extends above a top portion of the cabinet 26. The gaming machine 22 might also include a top box or other portion. Such a top box might include one or more display devices, such as in addition to one or more main displays which are associated with the cabinet 26. Also, the gaming machine 22 might include side displays (such as mounted to the exterior of the cabinet 26) and might include multiple displays of differing sizes.

While the display devices may comprise one or more video displays, (such as for presenting video poker, video slots or other video-based games) in another embodiment, the gaming machine 22 may include one or more physical reels capable of displaying game information, such as slot symbols. In such a configuration, means are provided for rotating the physical reels. In one or more embodiments, the means may comprise a mechanical linkage associated with a spin arm, with movement of the spin arm (a "pull") by a user causing the reels to spin. In such an arrangement, the reels are generally allowed to free-wheel and then stop. In another embodiment, electronically controlled mechanisms are arranged to rotate and stop each reel. Such mechanisms are well known to those of skill in the art. In this arrangement, actuation of the spin arm or depression a spin button causes a controller (not shown) to signal the activation of the spin mechanism associated with one or more of the reels. Preferably, the controller is arranged to either turn off the signal to the device(s) effecting the rotation of each or all of the reels or generates a signal for activating a braking device, whereby the reels are stopped. The principal of such an arrangement is described in U.S. Pat. No. 4,448,419 to Telnaes, which is incorporated herein by reference.

As described in more detail below, the gaming machine 22 is preferably configured to present one or more games upon a player making a monetary payment or wager. In this regard, as described in more detail below, the gaming machine 22 includes a mechanism or means for accepting monetary value.

In one embodiment, certain game outcomes (but preferably not all game outcomes) may be designated as winning outcomes (the non-winning outcomes may be referred to as losing outcomes). Prizes or awards may be provided for winning outcomes, such as monetary payments (or representations thereof, such as prize of credits), or promotional awards as detailed herein. As detailed below, the gaming machine 22 preferably includes a mechanism or means for returning unused monetary funds and/or dispensing winnings to a player.

The gaming machine 22 preferably includes one or more player input devices 30 (such as input buttons, plunger mechanisms, a touch-screen display, joystick, touch-pad or the like). These one or more devices 30 may be utilized by the player to facilitate game play, such as by providing input or instruction to the gaming machine 22. For example, such input devices 30 may be utilized by a player to place a wager, cause the gaming machine 22 to initiate a game, to "cash out" of the gaming machine, or to provide various other inputs. As illustrated, a button deck 40 may extend outwardly from the front of the cabinet 26 towards the player. The button deck 40 may support, for example, one or more of the input devices 30, such as buttons, a touch screen or the like.

In one preferred embodiment, the gaming machine 22 includes at least one microprocessor or controller for controlling the gaming machine, including receiving player input and sending output signals for controlling the various components or peripheral devices of the machine 22 (such as generating game information for display by the displays 28A,28B). The controller may be arranged to receive information regarding funds provided by a player to the gaming machine, receive input such as a purchase/bet signal when a purchase/bet button is depressed, and receive other inputs from a player. The controller may be arranged to generate information regarding a game, such as generating game information for display by the display 28A28B, for determining winning or losing game outcomes and for displaying information regarding awards for winning game outcomes, among other things.

The controller may be configured to execute machine readable code or "software" or otherwise process information, such as obtained from a remote server. Software or other instructions may be stored at a memory or data storage device, e.g. in a fixed or non-transitory configuration. The memory may also store other information or data, such as data stored in table or other forms (including, but not limited to look-up tables, pay tables and other information, including tracked game play information). The gaming machine 22 may also include one or more random number generators for generating random numbers (such as implemented by a random number generator software module stored in the memory and executable by the processor or controller), such as for use in selecting game information and presenting the game in a random fashion (e.g. whereby the game is presented in a manner in which the player cannot control the outcome) or pseudo-random fashion (e.g. such as where the game includes a skill component which can affect the outcome of the game).

Preferably, the controller is configured to execute machine readable code or instructions (e.g. software) which are configured to implement the game. In this regard, the gaming machine is specially configured to present the game of the invention via specific software and/or hardware which causes the gaming machine to operate uniquely. For example, the controller of the gaming machine 22 may be configured to detect a wager, such as a signal from a player's depressing of the "bet one" button (such as one of the buttons 30). Upon such an event and/or the player otherwise signaling the gaming machine to present the game, the controller may be configured to cause the at least one display 28 to display unique information, such as a unique graphical interface or unique game display, including game symbols or other game information (such as graphically represented images of cards, slot symbols, dice, etc.). The controller may accept input from a player of game inputs, such as a request to spin reels or the like, via the one or more player input devices of the gaming machine 22. As indicated above, the machine-readable code may be configured in various manners, such as by having various "modules" of software which are designed to implement specific features of the game play or game presentation.

The gaming machine 22 may be configured to generate and present games in a stand-alone manner or it may be in communication with one or more external devices at one or more times. For example, the gaming machine 22 may be configured as a server based device and obtain game code or game outcome information from a remote game server (in which event the gaming machine controller may receive game information from the server, such as game outcome information, and use that server-generated information to present the game at the gaming machine). For example, the gaming machine 22 might be configured as a stand-alone device or as a server-based device for presenting games as Class III games (as defined by the U.S. Indian Gaming Regulatory Act) or as a server-based device for presenting games as Class II games (as defined by the U.S. Indian Gaming Regulatory Act).

As indicated, the gaming machine 22 is configured to present one or more wagering games. The gaming machines 22 is preferably configured to accept value, such as in the form of coins, tokens, paper currency or other elements or devices representing value such as monetary funds. Thus, as indicated above, the gaming machine 22 preferably includes a mechanism or means for accepting monetary value. For example, while not shown in FIG. 1, the gaming machine 22 might include a coin acceptor for accepting coins. Of course, associated coin reading/verifying devices and coin storage devices may be associated with the gaming machine 22 if it is configured to accept coins. Likewise, the gaming machine 22 might include a currency accepting device having an acceptor slot or opening which is accessible through an access opening 34, such as in the front of the cabinet just above the button deck 40, as described in more detail below. As also described below, such a device may be configured to accept and read/verify paper currency and/or other media such as tickets (although the currency accepting device may be configured to accept and read not only currency, but tickets, media or elements other than currency, for ease of reference the device is referred to herein as a currency accepting device).

The gaming machine 22 might also be configured to read FOBs, magnetic stripe cards or other media having data associated therewith and via which value or funds may be associated with the gaming machine 22. The mechanism for accepting monetary value might also comprise hardware and/or software which allows a player to transfer (such as electronically) funds from an account, such as a casino wagering account, or a bank or other financial institution account. Such a mechanism might include a communication interface which permits the gaming machine to communicate with a mobile phone, PDA, tablet or other electronic device of the player (such as via a physical interface or wired or wireless communications links, such as to enable the transfer of funds from the player to the gaming machine or system).

When the player associates funds with the gaming machine or an associated system, a credit balance is generated. The credit balance may comprise a plurality of monetary value credits. The player may wager some or all of the associated monetary value, such as by wagering one or more of the credits associated with the credit balance. For example, the player might provide input to a wager button or touch screen interface to wager a certain number of credits (such as "Bet 1 Credit", "Bet 5 Credits", "Bet Maximum Credits" or other options). In one embodiment, when the player's wager is received, the player's credit balance is reduced by the number of wagered credits. The player might then provide a separate input to begin the game. In other embodiment, the player might select a "play game" input, such as by pressing a "spin" button, which input is taken to comprise both an instruction to place a wager (such as of a pre-set or pre-selected number of credits) and to start the game. Of course, other configurations may be implemented for accepting monetary value from the player and for allowing the player to place a wager from the associated monetary value.

In one embodiment, the gaming machine 22 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. These winnings may be associated with the player's credit balance, thus increasing the player's credit balance.

In one embodiment, the player may provide an input to the gaming machine 22 to indicate their desire to cash out, such as by selecting a "cash out" button (such as implemented via one of the buttons 30) or touch screen feature or providing other input. In response, a monetary value represented by the player's credit balance or the like is preferably paid, transferred or otherwise provided to the player. For example, upon an award or at cash-out, associated funds may be paid to the player by the gaming machine 22 dispensing coins to a coin tray. In another embodiment, funds may be issued by dispensing paper currency or other media. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference. In yet another embodiment, the cash-out might result in the dispensing of a card or other media which stores or represents the cashed-out funds, such as by writing funds information to a magnetic stripe of a card which is inserted into a media writer of the gaming machine or dispensed from the machine. In other embodiments, the cash-out mechanism may result in the funds value being transferred to an external device or account, such as a player's casino account (such as associated with a casino server), a remote bank or other financial account, or an electronic device such as a player's phone, PDA or tablet.

The gaming machine 22 may also include a player tracking device, such as a card reader and associated keypad. Such player tracking devices are well known and may permit the game operator to track play of players of the gaming machine. The tracked play may be utilized to offer player bonuses or awards.

A casino may have numerous such gaming machines 22, such as located on a casino floor or in other locations. Of course, such gaming machines 22 might be used in other environments, such as an airport, a bar or tavern or other locations.

It will be appreciated that the gaming machine illustrated in FIG. 1 is only exemplary of one embodiment of a gaming machine. For example, it is possible to for the gaming machine to have various other configurations, including different shapes and styles and having different components than as just described.

As noted, the gaming machine 22 may, as noted above, be part of a system which includes other devices. For example, the gaming machine 22 may communicate with one or more casino systems, such as a player tracking server or system, an accounting system or server, a ticketing system, a bonusing system, a tournament system, other gaming machines, and external devices.

As noted above, the gaming machine 22 may include a currency accepting device. In a preferred embodiment, the currency accepting device is configured to translate vertically, such as by moving along a substantially vertical path from a first vertical position or height to a second vertical position or height.

One embodiment of a vertically translating currency acceptor 100 and a gaming machine 22 having such a vertically translating currency acceptor 100, will be described in more detail with reference to FIGS. 2 and 3. In one embodiment, the currency acceptor 100 comprises a housing 102. The currency acceptor 100 includes an acceptor slot or opening 104, such as at a front of the housing 102 (the slot 104 itself may be defined by a head of a validator mechanism which extends out of the housing 102). Although not shown, the currency acceptor 100 may include at least one reader or validator mechanism configured to read and/or validator currency which is input into the acceptor slot 104, a currency storage or element such as a currency container, and one or more transport mechanisms configured to move currency which is inserted into the acceptor slot 104 past the one or more reader or validator mechanisms to the currency storage area. In one embodiment, the currency storage comprises a currency container which is selectably removable from an interior portion of the housing 102, such as by opening a front panel 103 thereof.

Of course, the currency acceptor 100 itself may have a variety of configurations, with such devices being well known and having various shape, sizes and features. In addition, as noted above, while the acceptor device 100 is referred to as a currency acceptor device due to its capability of accepting currency (e.g. printed/paper currency or bills), the acceptor device 100 could be configured to accept and/or read other media such as printed tickets and the like, such as described above (wherein such a ticket might have been generated as a result of a player cashing out at another gaming machine, might have been generated by a player providing funds to or accessing funds at a ticket-generating kiosk or the like, and which ticket may be presented by the player to the gaming machine in order to associate funds with the gaming machine). In such configurations, the currency acceptor might include a primary currency reader and a secondary ticket reader along a transport path and/or other features.

The currency acceptor 100 is supported by, and movable relative to, the gaming machine 22. In the embodiment illustrated in FIGS. 2 and 3, the currency acceptor 100 is located within an interior area of the cabinet 26 of the gaming machine 22. In this embodiment, the currency acceptor 100 is accessible by opening a top door (not shown in FIGS. 2 and 3, but see door 29A in FIG. 1).

In one embodiment, the currency acceptor 100 is mounted to a side wall 106 of the gaming machine cabinet 26. A mounting bracket or plate 108 is connected to the side wall 106, such as by connecting the mounting bracket or plate 108 to side wall mounts 110 which are connected to the side wall 106. In the embodiment illustrated, a top portion of the mounting bracket 108 is connected to a top side wall mount 110 and a bottom portion of the mounting bracket 108 is connected to a bottom side wall mount 110. Of course, the wall mounts 110 might be connected to the gaming machine 22 in various locations and via various mounting configurations (including, but not limited to fasteners, welding, riveting, etc.). Further, fewer or greater numbers of wall mounts 110 might be utilized. In other embodiments, the mounting bracket 108 might be connected to other portions of the cabinet 26 (such as to a rear wall, a bottom and/or to one or more of the walls), and may be mounted or connected to the cabinet 26 in entirely other manners.

In this configuration, the mounting bracket 108 is mounted in a generally vertical orientation. A front face 112 of the mounting bracket 108 is preferably generally planar and faces away from the side wall 106 of the gaming machine cabinet 26 and into the interior thereof.

The currency acceptor 100 is mounted to the mounting bracket 108. Preferably, the currency acceptor 100 is mounted to the mounting bracket 108 in a manner which permits the position of the currency acceptor 100 to be changed. Most preferably, the currency acceptor 100 can translate or move along a substantially vertical path from a first height or position to a second height or position.

In one embodiment, one or more slots 114 are defined in the mounting bracket 108. In the embodiment illustrated, two slots 114 are provided, one towards a front edge of the mounting bracket 108 and one towards a rear edge of the mounting bracket 108. Each slot 114 is oriented generally vertically. The currency acceptor 100 includes pins, bushings or other elements (not shown) which extend from the housing 102 (such as front one side thereof) into engagement with the slots 114. The pins or bushings may be metal (and might be lubricated to permit smooth movement in the slots 114) or may be made of other materials. As one example, the slots 114 might be lined with a polymer insert to facilitate smooth movement of the pins/bushings therein or the pins might have a nylon bushing located over them that travels in or engages the slots 114. In this manner, the currency acceptor 100 is mounted to the mounting bracket 108 (and thus the gaming machine cabinet 26), and yet the currency acceptor 100 is movable along a vertically oriented path by sliding the pins or other mounts along the slots 114.

In one embodiment, the vertical position of the currency acceptor 100 may be fixed in one or more positions. Preferably, the position of the currency acceptor 100 can be fixed in a first or lower position or height, such as illustrated in FIG. 2. For example, once the currency acceptor 100 is moved to this position, a locking pin 116 may be inserted into one or more mounting holes (not shown) in the mounting bracket 108. Once positioned, a top portion of the currency acceptor 100 may abut the locking pin 116 to prevent upward movement of the currency acceptor 100, as illustrated in FIG. 2. The locking pin 116 might comprise, for example, a spring-biased pin (such as where the locking pin 116 is biased in to an extended, locking position and the user must pull the pin rearwardly in order to disengage it). In other embodiments, the locking pin 116 might comprise the shank of a lock which is passed through aligned holes in the housing 102 of the currency acceptor 100 and the mounting bracket 108 (whereby the position of the currency acceptor 102 may be secured or only changed by an authorized person having a key to the lock).

Figure 2:
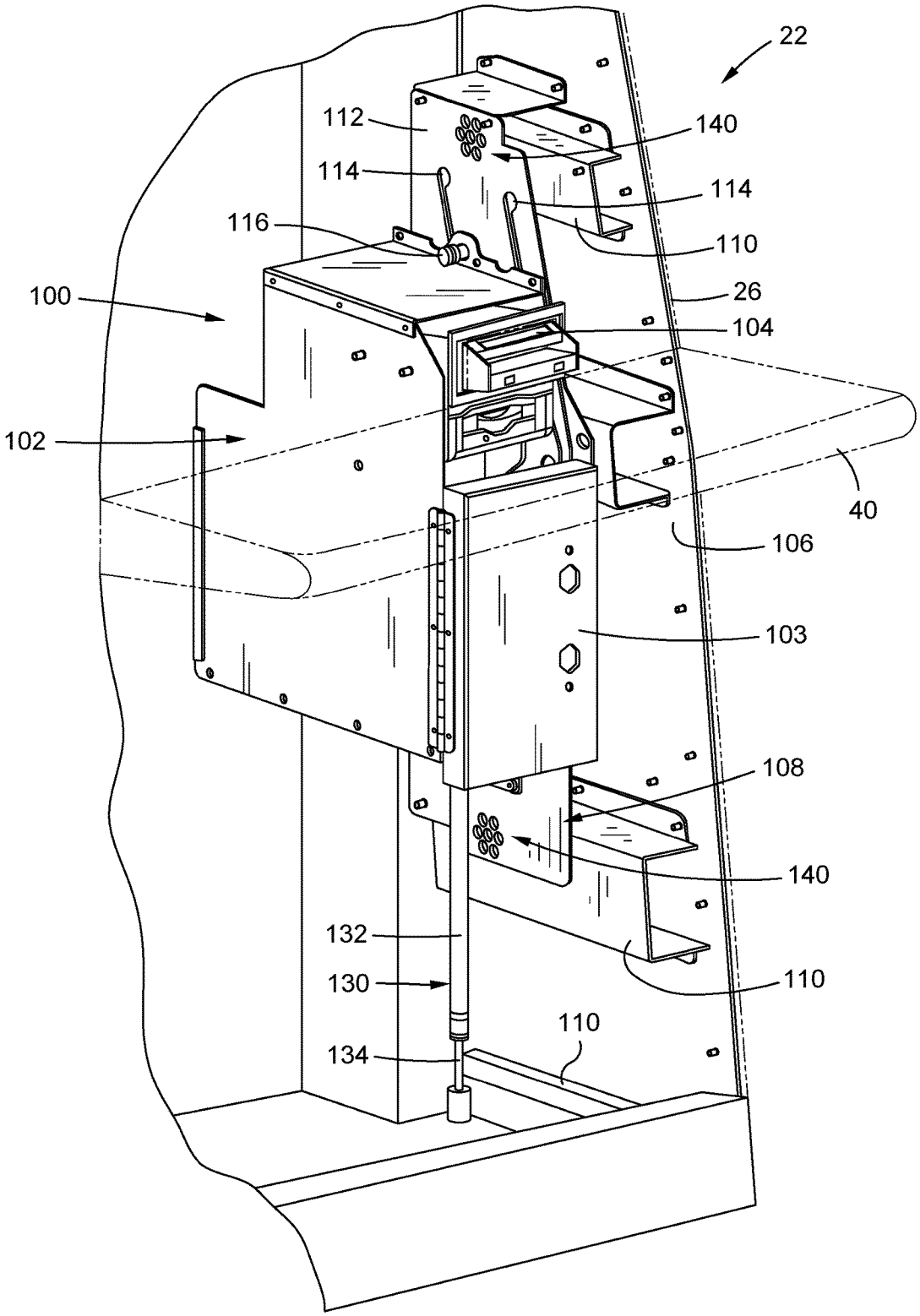
FIG. 2 illustrates a currency accepting device of the gaming machine illustrated in FIG. 1 in a first position.
Figure 3:
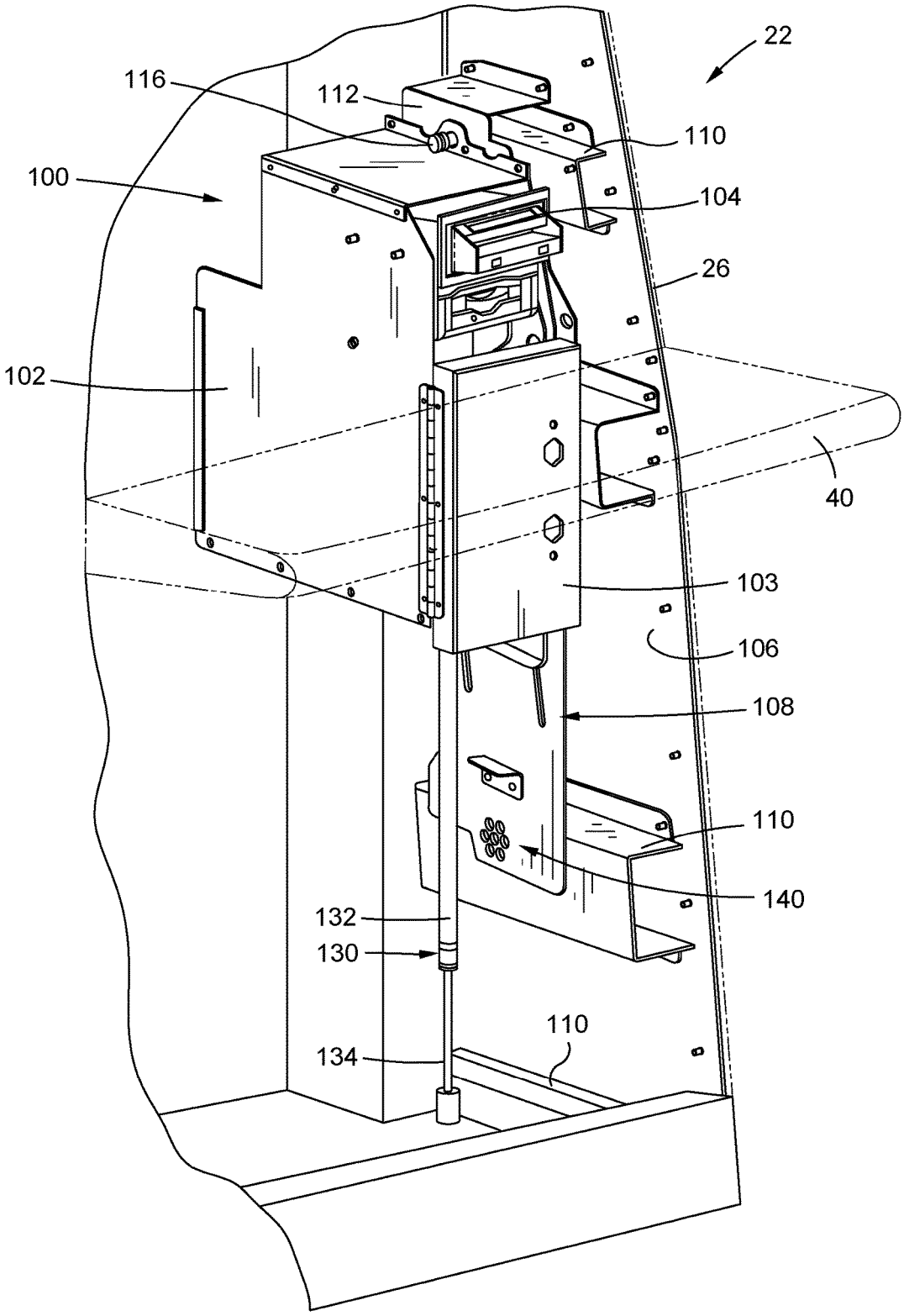
FIG. 3 illustrates a currency accepting device of the gaming machine illustrated in FIG. 2 in a second position.

The currency acceptor 100 can be moved vertically upward, such as from its first, lowered position in FIG. 2, to one or more raised positions, such as a second, raised position as illustrated in FIG. 3. In one embodiment, the currency acceptor 100 can be positioned in a plurality of vertical positions between the first and second positions, if desired. In one embodiment, means may be provided for retaining the currency acceptor 100 in its second, raised position. This means may comprise, for example, an offset portion of the slot(s) 114, a locking pin or other elements.

In one embodiment, a means for biasing the currency acceptor is provided. Preferably, the means for biasing biases the currency acceptor 100 upwardly, e.g. towards the second, raised position. As illustrated, the means for biasing may comprise a gas shock 130. The shock 130 may have a main body 132 and an extendable arm 134. One end of the shock 130, such as an end of the body 132, may be mounted to the housing 102 of the currency acceptor 100. An opposing end of the shock, such as an end of the arm 134, may be mounted to the cabinet 26 of the gaming machine 22, such as via another mount 110. Preferably, the shock 130 is configured so that the arm 134 is biased outwardly of the body 132 (such as via pneumatic gas pressure or the like). So mounted, the shock 130 generates a biasing force which biases the currency acceptor 100 in the upward direction.

Of course, other means for biasing might be provided. For example, two or more shocks might be provided. Alternatively, or in addition, springs or the like might be used to either push the currency acceptor 100 upwardly from the bottom or pull it upwardly from the top. In one embodiment, one or more motors might be used to change the position of the currency acceptor 100, such as via one or more belts, gears, slides or the like, wherein rotation of a shaft of the motor or movement of a piston arm thereof causes the position of the currency acceptor 100 to change.

In a method of use, a currency acceptor may be moved from a first vertical position to a second vertical position. First, a user gains access to the currency acceptor 100. This may comprise, for example, opening a door of the gaming machine 22. Referring to FIG. 2, the currency acceptor 100 is illustrated in its first, lowered position. The user may remove or release the locking pin 116. At this time, the shock 130 (or other means for biasing) either causes the currency acceptor 100 to move upwardly, or aids the user in moving the currency acceptor 100 upwardly. In this embodiment, the currency acceptor 100 slides or translates along a substantially vertical path (such as along the slots 114 in the mounting bracket 108).

The currency acceptor 100 may be moved to a second or raised position, such as illustrated in FIG. 3. In one embodiment, the currency acceptor 100 may be stopped at a top raised position and maintained there, such as by the biasing force generated by the shock 130 (although in other embodiments, as noted above, the position of the currency acceptor 100 might be fixed or locked, such as with a locking pin or the like).

The user may return the currency acceptor 100 to its lowered position (as illustrated in FIG. 2) by pressing the currency acceptor 100 downwardly to the desired lowered position. The user may then lock the currency acceptor 100 in that position using the locking pin 116.

Another aspect of the invention is a position adjustment for a currency acceptor 100. It is desirable for the slot 104 of the currency acceptor 100 to be aligned with the access opening 34 in the cabinet 26. Preferably, a lower or ramp portion of the currency acceptor 100 at the slot 104 is positioned at the same vertical level as the bottom of the access opening 34, and is positioned adjacent to a back ledge or edge of the access opening (to prevent, for example, a player from trying to insert a bill or ticket and having it go through a gap between the housing 26 and the currency acceptor 100, rather than into the currency acceptor 100).

As noted above, in one embodiment, a pin 116 or the like may be used to fix the position of the currency acceptor 100 into a desired vertical position (e.g. to fix it in a "y"-axis or vertical direction). However, the position of the currency acceptor 100 is preferably also adjustable in the "z"-axis, or front to back, direction. Referring to FIGS. 2 and 3, the mounting bracket 108 may be provided with a plurality of mounting holes or apertures 140 which correspond to mating mounting holes or apertures (not visible) in the cabinet 26 or, more preferably, the wall mount 110. In the embodiment illustrated in FIGS. 2 and 3, a first set of such holes 140 may be provided at the top of the mounting bracket 108 and a second set of such holes 140 may be provided at the bottom of the mounting bracket 108. However, additional or other sets of holes might be provided.

Figure 4:
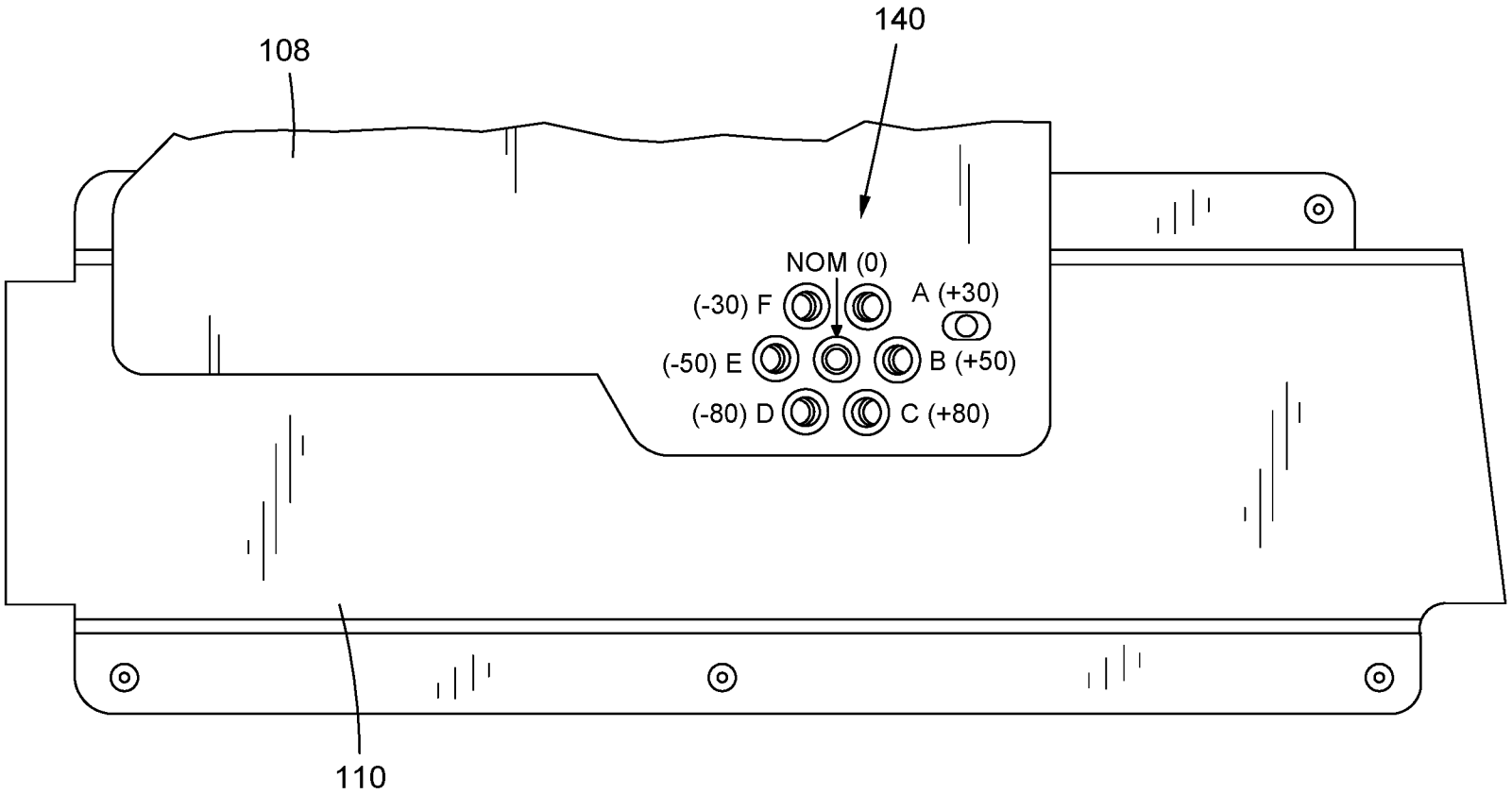
FIG. 4 illustrates a currency accepting device position adjustment feature in accordance with the present invention.

As illustrated in FIG. 4, in one embodiment, the mounting holes 140 preferably comprise a plurality of mounting holes which are located in different locations or positions. The mounting holes 140 may be arranged in various patterns. In the embodiment illustrated, the mounting holes 140 comprise seven (7) holes which define a base or nominal position (NOM or 0), a first forward position such as a position A which is 0.030" forward of nominal, a second forward position such as a position B which is 0.050" forward of nominal, a third forward position such as a position C which is 0.080" forward of nominal, a fourth position such as a position D which is 0.030" rearward of nominal, a fifth position such as a position E which is 0.050" rearward of nominal, and a sixth position such as a position F which is 0.080" rearward of nominal. Of course, other numbers of mounting holes or apertures might be provided (including a greater or lesser number) and their positions, such as relative to a nominal position, might vary (in one embodiment, a nominal position might not be defined).

In use, the user locates the currency acceptor 100 in a desired position relative to the gaming machine 22 (for example, as described above where a ramp portion adjacent to the slot 104 is positioned at or against the rear edge or ledge of the cabinet 26 at the access opening 34). The user then places a fastener through the mounting hole 140 in the bracket 108 which aligns with the corresponding mounting hole (not shown) in the wall mount 110 (or slightly moves the currency acceptor 100 so to find the closest aligned set of mounting holes). The user then tightens the fastener to secure the "z" position of the currency acceptor 100 (preferably, a fastener such as a screw or bolt is passed into engagement with the same mounting hole in the top and bottom sets of mounting holes 140 in the embodiment illustrated in FIGS. 2 and 3).

As one example of use, referring to FIG. 4, while the nominal position might be used most often, an operator might locate the currency acceptor 100 in the cabinet 26 and find that it hits the cabinet. The operator might have to slide the currency acceptor 100 backwards. The currency acceptor 100 might be properly positioned when the mounting hole in position D is aligned with its corresponding opening or hole in the wall mount 110 (e.g. in a position where the currency acceptor 100 is located 0.080" rearwardly of the normal or nominal position). The operator would then pass a fastener through the aperture at position D to secure the currency acceptor 100.

In one embodiment, the user might use a fastener such as a screw or bolt to secure the currency acceptor 100. However, in other embodiments, other types of fasteners or connectors might be used, such as pins (including biased pins). It is also possible for multiple mounting positions to be defined by an elongate slot or the like, such as where the housing of the currency acceptor 100 defines an elongate slot which accepts a pin which extends from the cabinet 26 and the "z" position of the currency acceptor may be fixed by tightening a nut or the like down on the pin against the housing of the current acceptor.

Various features and advantages or the invention will now be described. The vertically translating currency acceptor 100 of the invention facilitates ease of access thereto. For example, in the embodiment illustrated in FIG. 2, in the use position the currency acceptor 100 is desirably located so that the acceptor slot 104 thereof is positioned just above the fixed-position button deck 40 of the gaming machine 22 in alignment with the access opening 34 (as illustrated in FIG. 1). In this position, the acceptor head and associated slot 104 are located a first vertical distance above the button deck 40.

In the normal use position as illustrated in FIG. 1, portions of the currency acceptor head and the currency container are located in the interior of the gaming machine 22 where they are generally inaccessible behind the button deck 40. In accordance with the invention, however, the currency acceptor 100 can be raised vertically, such as to the position illustrated in FIG. 3. In this position, the currency acceptor 100 is located in a second position where it is easier to access and service, such as by having at least the currency acceptor head and associated slot 104 no longer positioned directly behind the button deck 40 (but are positioned a second vertical distance above the deck, where the second distance is greater than the first distance). In this second position, the head of the currency acceptor 100 can be readily accessed, such as to repair and/or replace the head, including in the case the currency acceptor 100 becomes jammed.

Thus, in accordance with the invention, the currency acceptor 100 can be positioned in the most desirable location for player access, even when that position does not provide user or service access, since the currency acceptor can be moved to a convenient service position. The invention has particular utility to a gaming machine 22 such as that which is illustrated where the button deck 40 is in a fixed location and the desired use position of the currency acceptor 100 (such as where the acceptor head is located adjacent to the top of that deck) prevents service access to the currency acceptor 100 (although the present invention has utility to gaming machines having other configurations, such as where other features limit access to the currency acceptor 100 for service). In addition, the configuration of the invention allows "single door" access to the currency acceptor 100 (e.g. a technician can unlock just one service door to the gaming machine, rather than requiring the gaming machine to have multiple access doors and the unlocking of multiple doors, in order to access and service the currency acceptor 100).

Another advantage to the invention is that the vertical translation of the currency acceptor 100 allows it to be moved even in gaming cabinets which are relatively shallow in depth. For a variety of reasons, including to take up less casino floor space, gaming machines are being designed with smaller cabinets (including ones which are much shallower, e.g. have a reduced depth dimension). Existing solutions to providing access to currency acceptors, such as the rotating bill acceptor in U.S. Pat. No. 5,676,231, will not work in this type of environment because there is insufficient space to allow the acceptor to rotate between its use and access position (for example, a height of the currency acceptor 100 is greater than a depth of the cabinet 26). On the other hand, because the entire currency acceptor 100 of the present invention moves vertically, no additional cabinet depth is need to permit movement of the currency acceptor 100 beyond the depth which is simply required for the currency acceptor itself 100.

It is also noted that in other configurations, the currency acceptor might be located in a second, raised position when it is in its normal use position. The user might then lower (e.g. move the currency acceptor downwardly along a substantially vertical path) to the first, lowered position in order to make it more accessible for service.

The design of the currency acceptor 100 can also be relatively simple. As noted, in one embodiment, the currency acceptor 100 may simply slide along a mounting bracket 108.

As noted herein, the vertically translating currency acceptor 100 of the present invention may be used in gaming machines or devices having other configurations than just described.

The vertically translating currency acceptor 100 might also have other configurations than illustrated in FIGS. 2 and 3. For example, in one embodiment pins might extend outwardly from the side wall mounts 110 through the slots 114 in the mounting bracket 108. The housing 102 of the currency accept 100 may be fixed to the bracket 108. In this configuration, the currency acceptor 100 could be moved vertically by changing the entire position of the bracket 108 relative to the cabinet 26 of the gaming machine 22 (rather than by changing the position of the currency acceptor 100 relative to the mounting bracket 108).

Also, instead of facilitating vertical movement by a pin and slot arrangement, the currency acceptor 100 might be mounted on a sliding rail, via bearings or other means which permits movement thereof. It is also possible to move the currency acceptor 100 via a motor or the like, such as by using a gear drive, belt, etc.

The one or more locking elements for retaining the currency acceptor 100 in a designated vertical position may comprise elements other than pins, such as latches, catches and other elements, and most preferably elements which are user actuatable between engaged and disengaged positions.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A gaming machine comprising:

a cabinet defining at least one interior space;

a button deck which extends outwardly from said cabinet;

at least one display device;

at least one player input device;

a memory device;

a controller;

machine-readable code stored in said memory device and executable by said controller to present one or more wagering games comprising the display of game information via said at least one display device; and a currency acceptor having a currency acceptor head, said currency acceptor at least partially located in said at least one interior space and movably mounted to said cabinet for movement between a first vertical position and a second vertical position along a substantially vertical path, said currency acceptor head positioned above said button deck by a first distance when said currency acceptor is in said first vertical position and positioned above said button deck by a second distance which is greater than said first distance when said currency acceptor is in said second vertical position.

2. The gaming machine in accordance with claim 1 wherein said currency acceptor is movably mounted to a mounting bracket which is connected to said cabinet.

3. The gaming machine in accordance with claim 2 wherein said mounting bracket defines at least one generally vertically extending slot and said currency acceptor is movably mounted along said at least one slot.

4. The gaming machine in accordance with claim 3 wherein said currency acceptor is movably mounted along said at least one slot by at least one pin which engages said at least one slot.

5. The gaming machine in accordance with claim 1 further comprising means for biasing which generates an upward biasing force upon said currency acceptor.

6. The gaming machine in accordance with claim 5 wherein said means for biasing comprises at least one shock having a body and an arm, said arm biased outwardly of said body.

7. The gaming machine in accordance with claim 5 wherein said shock has a first end and a second end, one of said ends connected to said currency acceptor and the other of said ends supported by said cabinet of said gaming machine.

8. The gaming machine in accordance with claim 5 further comprising at least one locking element locking said currency acceptor in said first vertical position against said biasing force.

9. The gaming machine in accordance with claim 8 wherein said at least one locking element comprises at least one locking pin which engages a mounting bracket which is connected to said cabinet of said gaming machine.

10. The gaming machine in accordance with claim 1 further comprising a biasing shock which is located below said currency acceptor and generates an upward biasing force upon said currency acceptor.

11. The gaming machine in accordance with claim 1 wherein said currency acceptor further comprises a housing, at least one reader, a currency storage area and at least one currency transport mechanism.

12. The gaming machine in accordance with claim 1 wherein said currency acceptor is configured to accept currency and printed monetary value tickets.

13. The gaming machine in accordance with claim 1 wherein said currency acceptor is movably mounted to an interior side of said cabinet.

14. The gaming machine in accordance with claim 1 wherein said at least one interior space is accessible via a door which is positioned above said button deck and said currency acceptor is accessible when said door is in an open position.

15. The gaming machine in accordance with claim 14 wherein said currency acceptor includes a currency accepting head and said currency accepting head is accessible when said door is in said open position and said currency acceptor is in said second vertical position.

16. The gaming machine in accordance with claim 1 wherein said cabinet has a reduced depth dimension from a front to a back of said cabinet which is less than at least one dimension of said currency acceptor.

17. A gaming machine comprising:

a cabinet defining at least one interior space;

a mounting bracket connected to said cabinet, said mounting bracket defining at least two mounting apertures therein which are in different positions relative to a z-axis passing through a front and back of said cabinet;

at least one display device;

at least one player input device;

a memory device;

a controller;

machine-readable code stored in said memory device and executable by said controller to present one or more wagering games comprising the display of game information via said at least one display device; and a currency acceptor at least partially located in said at least one interior space and movably mounted to said mounting bracket, wherein a position of said currency acceptor may be adjusted to a first position along said z axis by moving said currency acceptor to said first position and engaging a fastener with a first one of said mounting apertures and may be adjusted to a second position along said z axis by moving said currency acceptor to said second position and engaging said fastener with a second one of said mounting apertures.

18. The gaming machine in accordance with claim 17 wherein said mounting bracket is connected to a mount of said cabinet and said cabinet defines at least one mounting hole and said fastener is engaged with one of said at least two mounting apertures and said at least one mounting hole.

19. The gaming machine in accordance with claim 17 wherein said a currency acceptor is further movably mounted to said cabinet for movement between a first vertical position and a second vertical position.

20. The gaming machine in accordance with claim 19 wherein said mounting bracket defines at least one sloping slot and said currency acceptor is movably mounted to said at least one sloping slot via at least one pin, whereby movement of said currency acceptor along said at least one sloping slot changes a position of said currency acceptor relative to said z axis and a y axis which is perpendicular to said z axis.

* * * * *